United States Patent [19]

Schlage

[11] 4,028,917

[45] June 14, 1977

[54] KEY RETAINING CYLINDER FOR A LOCK

[75] Inventor: Ernest L. Schlage, Burlingame, Calif.

[73] Assignee: Schlage Lock Company, San Francisco, Calif.

[22] Filed: Apr. 12, 1976

[21] Appl. No.: 676,213

[52] U.S. Cl. ..... 70/389; 70/372

[51] Int. Cl.[2] ..... E05B 11/00

[58] Field of Search ..... 70/389, 352, 372, DIG. 42, 70/364 A, 365, 366

[56] References Cited

UNITED STATES PATENTS 3,702,550 11/1972 Shimizu ..... 70/252

FOREIGN PATENTS OR APPLICATIONS 66,097 4/1943 Norway ..... 70/DIG. 42

*Primary Examiner*—Robert L. Wolfe

*Attorney, Agent, or Firm*—Lothrop & West

[57] ABSTRACT

A key retaining cylinder lock device has a cylinder body with a bore therein extending along an axis. A plug is rotatable in said bore about the axis and is confined against axial translation. The plug has an axially extending keyway therein open to said bore and adapted to receive a key having an edge notch partly defined by an inner wall extending at least partially transversely of said axis. The plug also has a circumferential groove open to the keyway and open to a chamber in part defined by a plug chordal surface lying on both sides of the keyway and substantially perpendicular to the plane of symmetry of the keyway. In the groove and chamber is a partial ring having a central, inwardly directed lug adapted to contact the plug chordal surface with rotary lost motion therebetween. The partial ring has end shoes in frictional braking contact with the wall of the bore and is movable between a first position out of the keyway and a second position in the keyway in the path of the notch inner wall during withdrawal of the key from the keyway. The plug has a rotary lost motion disc connected to a flat driver bar, the connector disc having an opening partly bounded by a disc chordal surface parallel to the plug chordal surface. The driver bar is connected to reciprocate a bolt.

13 Claims, 13 Drawing Figures

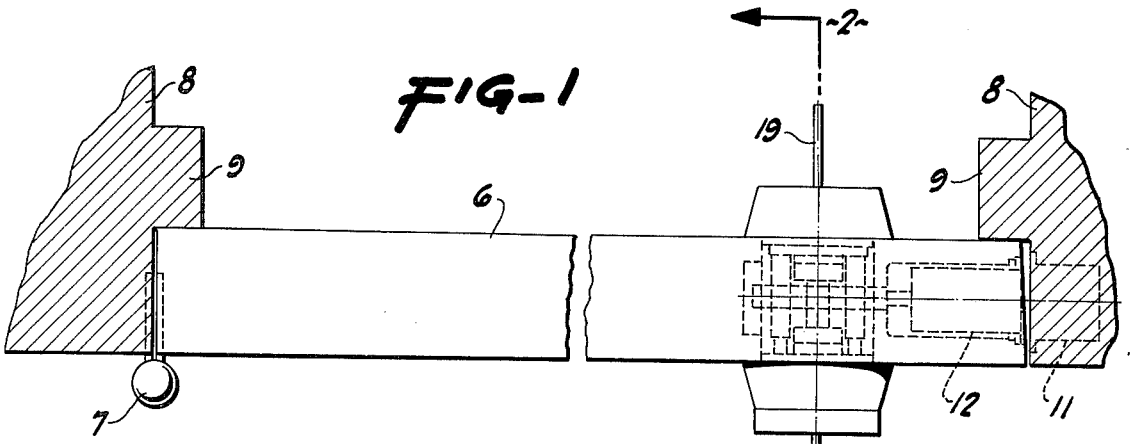
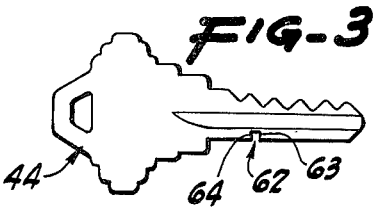
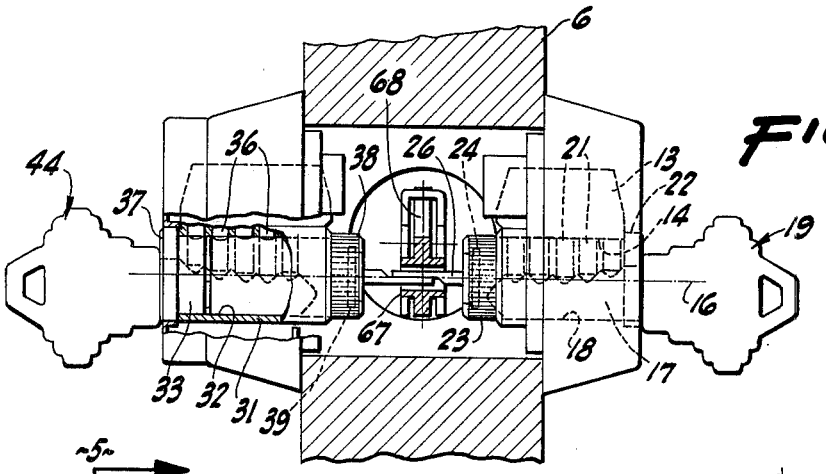
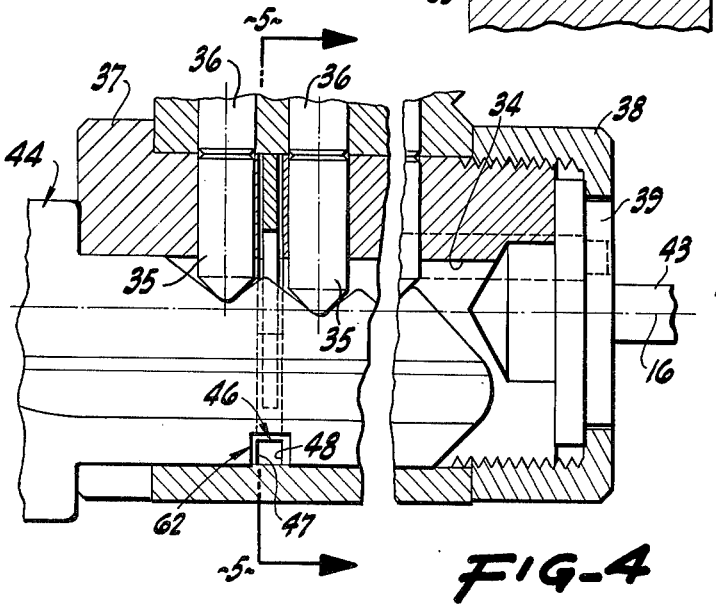
FIG-4
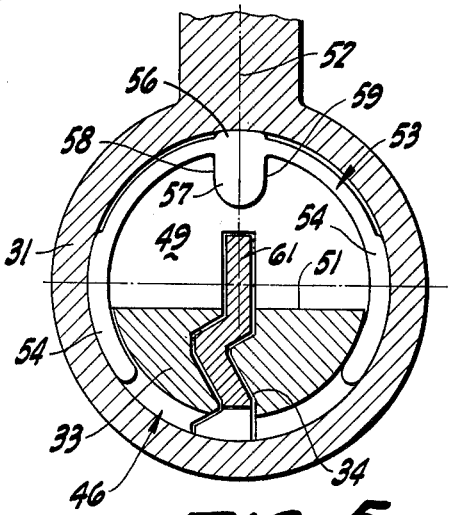
FIG-5

KEY RETAINING CYLINDER FOR A LOCK

BACKGROUND OF THE INVENTION

The closest prior art presently known to the applicant includes E. L. Schlage U.S. Pat. Nos. 2,803,959 of Aug. 27, 1957, 3,257,831 of June 28, 1966 and 3,575,024 of Apr. 13, 1971. Of interest may be Tornoe U.S. Pat. No. 2,738,666 of Mar. 20, 1956 and Neary U.S. Pat. No. 3,824,819 of July 23, 1974.

While deadbolts have been mounted on hinged door panels to interconnect them with the door frame for a long time, there has recently been an increasing tendency to use deadbolts operable by keys from both sides in order to afford the highest security. In instances wherein in inside of the door is the sole exit from a room, there is danger in that the user may withdraw the key from the lock after having locked himself in. This may be satisfactory from the standpoint of security, but it can be dangerous under fire or other panic conditions as the user may misplace the key or in a panic be unable to retrieve the key for use.

It is therefore an object of the invention to provide a key retaining cylinder for a lock effective to keep the key in the lock whenever the lock bolt is extended or in locked position, particularly in a cylinder installed on the interior side of a door panel.

Another object of the invention is to provide a key retaining cylinder for a lock in which the operating key cannot be removed from the cylinder except when the bolt controlled by the lock is in its retracted or open position.

Another object of the invention is to provide a key retaining cylinder for a lock in which substantially standard lock parts are utilized for most of the structure, the retaining feature being incorporated in a simple, effective, economical fashion.

Another object of the invention is to provide a key retaining cylinder for a lock which additionally may have a shut-out feature.

A further object of the invention is to provide a key retaining cylinder for a lock which does not differ substantially in appearance or in regular operation from locks that are virtually standard and are well recognized.

Other objects of the invention, together with the foregoing, are attained in the embodiment of the invention described in the accompanying description and illustrated in the accompanying drawings, in which:

FIG. 1 is a plan of a mechanism pursuant to the invention, a portion of the view being in cross-section on a horizontal plane through a door frame on which the lock mechanism is installed, portions being broken away;

FIG. 2 is a cross-sectional view of the mechanism of FIG. 1, the plane of section being indicated by the line 2—2 of FIG. 1;

FIG. 3 is a side elevation of a key arranged for use in the present device;

FIG. 4 is an enlarged view of the interior cylinder portion of the mechanism shown in FIG. 2, parts being broken away to reduce the size of the figure;

FIG. 5 is a cross-section, the plane of which is indicated by the line 5—5 of FIG. 4;

Figure 8:
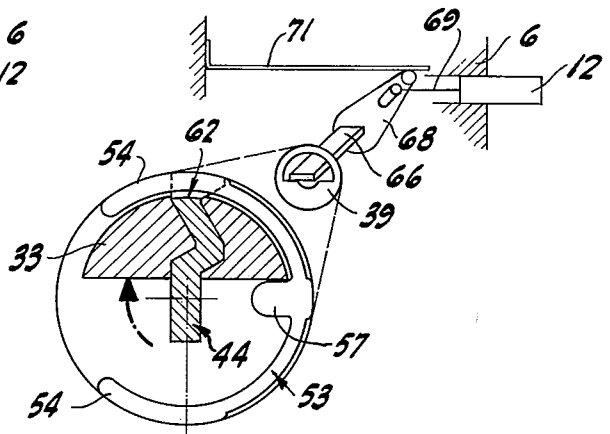
FIG. 8 is a view like FIG. 7 but with the key and plug rotated another quarter turn in a clockwise direction and with the bolt projected.

While the drawings and disclosure herein are, for convenience, primarily for a pin tumbler, axial keyway device, the arrangement can be incorporated in wafer or disc tumbler cylinders and in axial pin cylinders as well.

In a typical installation, a door panel 6 is mounted on hinges 7 to swing into and out from a door frame 8 having a door stop 9 to fix the closed position of the panel. In most instances one side of the panel 6 is referred to as the interior or inside, whereas the opposite side is referred to as the exterior or outside. The reference in some cases is arbitrary, as both sides of the panel may have equal significance, but for all instances and for convenience herein the hinge side of the panel is referred to as the inside and the other side is referred to as the outside.

To secure the panel 6 in closed position to the door frame 8 there is provided a double cylinder lock mechanism including a strike box 11 set in the door frame 8 and positioned to receive a reciprocable deadbolt 12. The deadbolt is reciprocable from the exterior and the interior by key operated cylinder lock mechanisms.

The exterior installation includes a cylinder body 13 having a circular bore 14 symmetrical with a through axis 6 also the axis for the interior installation. Rotatable in the cylinder body 13 about the axis 16 is a cylinder plug 17 having a keyway 18 therein extending from end to end of the plug and open to the interior of the bore 14. A standard key 19 is receivable in the keyway and actuates tumbler pins 21 in the usual fashion. The key also rotates the plug about the axis 16, but the plug is kept from axial movement by an enlarged flange 22 at one end and a removable but locked collar 23 at the other end.

Seated on the inner end of the plug and confined by the collar 23 is a disc 24 pinned to rotate with the plug. A driver bar 26 passes through the disc with a partial rotary driving and a partial lost motion connection. The driver bar is substantially flat and is offset at one end to enter into and occupy one part of a crank driving connection to the bolt 12, later described.

When a proper key 19 is in the keyway in the plug 17 and is rotated, there may be some rotary lost motion, but then the driver bar projects the bolt. The key can be reversely rotated and withdrawn from the plug, leaving the bolt in projected or extended position. The key can also be rotated farther in a reverse direction, thus retracting the bolt, and can then, usually with lost motion, return to a normal, central position and be withdrawn, leaving the bolt in retracted position.

The interior installation includes a cylinder body 31 having a circular-cylindrical bore 32 therein symmetrical about the axis 16. Rotatable about the axis 16 in the body is a plug 33 having a keyway 34 extending from end to end thereof generally along the axis. The plug is designed to receive pins 35 cooperating with pins 36 in the cylinder body in the usual way. The plug, although rotatable about the axis 16, is restrained axially by a flange 37 abutting the exterior of the body and by a removable collar 38. Within the collar and pinned to the plug to preclude relative rotation therebetween is a disc 39 having an opening 41 therein partly bounded by a chordal surface 42. The disc, by means of the chordal surface, makes a rotary lost motion connection with a driver bar 43 having flat sides to engage the surface 42 in two positions and is also offset to overlap the driver bar 26 in the crank connection.

An interior key 44 is axially receivable in the keyway 34 and when rotated also rotates the plug 33 and the driver bar 43. If the construction were identical to the construction of the exterior installation, the key 44 could be operated in the same way to produce like results. However, the construction of the interior mechanism is different.

At a convenient location axially between the ends of the plug 33 and alongside one of the pins 36, the plug is provided with a circumferential groove 46 open to the interior of the bore 32 and also intersecting the keyway 34. The groove is preferably substantially rectangular in axial cross-section, being bounded in part by an exterior transverse wall 47 and an interior transverse wall 48. The groove 46 merges into a chamber 49 intersecting the keyway 34, the chamber being in part bounded by the wall of the body bore 32, by the walls 47 and 48 and their extensions and particularly by a plug chordal surface 51 that extends on opposite sides of the keyway 34 and is in a plane substantially perpendicular to the central plane of symmetry 52 of the plug 33, as seen in FIG. 5.

Arranged to occupy part of the groove 46 and part of the chamber 49 is a flat, partial ring 53, generally symmetrical about the plane 52, as seen in FIG. 5. At its spaced apart ends, the ring is enlarged to provide friction shoes 54, a central friction shoe 56 also being provided. The shoes afford spaced apart areas for contact with the wall of the bore 32. Since there are intervening ring portions spaced from the bore wall and since the shoes can ride in firm frictional engagement with the bore wall, the partial ring has a smooth frictional braking engagement with the bore wall without chattering or stick-slip friction. The ring unless impelled by a superior force tends to remain in engagement with the body 31, without relative motion. Projecting inwardly from the partial ring in a symmetrical position is a lug 57 within the thickness of the flat ring 53 and having side faces 58 and 59 effective to abut the plug chordal surface 51 upon ninety degrees of ring rotation in either direction.

The partial ring is mounted for rotation about the axis 16 between a first position with both end shoes 54 or ring ends out of or away from the keyway 34 and a second position with one or the other of the end shoes 54 or ring ends in or extending across the keyway 34.

For use with the interior installation, the key 44 is generally like the key 19, although preferably having a different combination contour or edge notching. The key 44 is specially provided in one edge with a rectangular notch 62 of about the same cross-sectional shape as the cross-section of the ring end shoes 54 but slightly larger, so that such shoes (and adjacent parts of the ring) can pass freely into and through the notch. The notch 62 is preferably bounded in part by an interior transverse wall 63 and an exterior transverse wall 64 spaced so that the ring 53 when in the notch substantially occupies or fills the notch. When the key is in the keyway and the ring is out of the notch, the key can readily be withdrawn in the usual way. But when the key is fully in the keyway and the ring is in its second position extending across the keyway and substantially occupying the notch, the key cannot be withdrawn at all. Since the ring is rectangular in cross-section and substantially fills the similarly rectangular notch, there can be no wedging or camming action by an axial withdrawing force on the key to force the ring away. The key is firmly retained against a large withdrawing force.

The walls 63 and 64 of the notch, particularly the wall 63, need not be exactly transverse or in planes perpendicular to the axis, but could be oriented or disposed at least partially transversely of the axis so that axial forces acting against them do not resolve into large pressures tending to shift the key transversely of the keyway and tending to shift the partial ring transversely of the groove. Some wall inclination and some resulting camming are acceptable, provided only that the key retaining function is performed.

Figure 6:
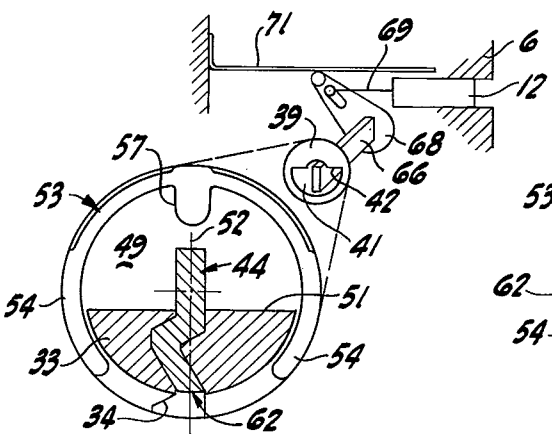
FIG. 6 is a diagrammatic or schematic view showing the association between some of the cylinder mechanism and the bolt mechanism of the lock, the cylinder plug being shown in cross-section and some other parts being shown in isometric perspective, the cylinder plug being in a key receiving and extracting position and the lock bolt being retracted.

Advantage of this construction is taken to afford a special operation of the interior installation by key, but so that the key cannot be withdrawn when the bolt is projected, but only when the bolt is retracted. The operation is illustrated in FIGS. 6 through 12. Starting, as shown in FIG. 6, with the bolt 12 retracted, the plug 33 and the ring 53 symmetrical with the plane 52 and with the disc 39 disposed with the disc chordal surface fixed to lie parallel with the plug chordal surface 51, a diagramatic driver bar 66, like the driver bar 43, is symmetrically disposed coplanar with the keyway 34. The driver bar 66 overlaps the driver bar 26 within the hub 67 of a crank 68 having a radial lost motion connection to a link 69 secured to the bolt 12. A leaf spring 71 is displaced and stressed by the crank except at the extreme positions of the crank and affords a snap action for the bolt travel.

Figure 7:
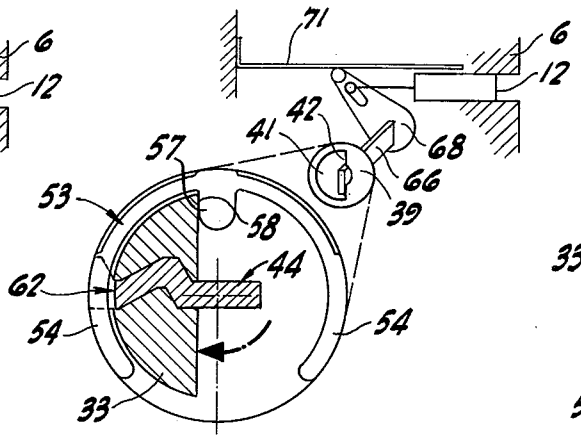
FIG. 7 is a simplified view like FIG. 6, some parts being omitted, but with the key and plug rotated a quarter turn in a clockwise direction.

When the key 44 is manually rotated clockwise from the starting position, FIG. 6, through ninety degrees into the FIG. 7 position, the chordal surfaces 51 and 42 are repositioned to abut the ring central lug 57 and the side of the flat driver bar 66, the bolt remaining retracted as the lost motion is taken up. During this motion of the plug 33, the ring 53 remains frictionally in place. But the key 44 in rotating with the plug moves relative to the ring, so that the key notch 62 passes over the ring end; i.e., the key and the ring have relative motion between a first position and a second position and the key, whether or not otherwise blocked, cannot be withdrawn. A further ninety degree clockwise manual rotation into the FIG. 8 position causes the plug surface 51 to press the central lug 57 and the ring to move the ring end shoe 54 through a quarter turn with the end shoe 54 still in the key notch 62. Also, the plug disc 39 is comparably rotated and, since the plug chordal surface 42 is in abutment with the flat side of the driver bar 66, the crank 68 is rotated a quarter turn and moves the link 69 to project the bolt 12, the spring 71 being flexed and relaxed during such motion.

Figure 9:
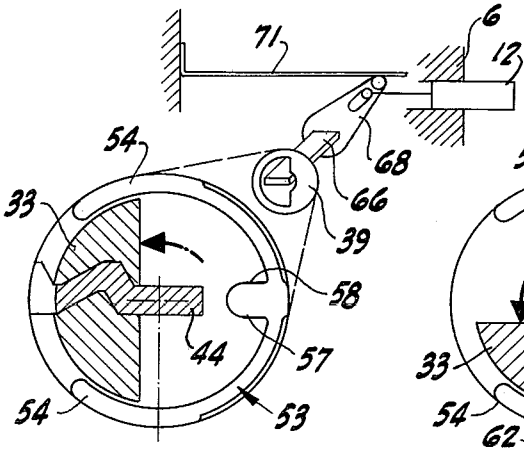
FIG. 9 is a view like FIG. 8 with the key and plug turned back a quarter turn from the FIG. 8 position in a counterclockwise direction and with the bolt still projected.

Movement from the FIG. 8 position to the FIG. 9 position is accomplished by a counterclockwise, 90° turn of the key 44. This leaves the bolt projected and the ring still in the FIG. 8 position. This further 90° counterclockwise turn of the key moves the plug 33 and the disc 39 into intermediate positions, taking up some lost motion. The key notch and the ring are disengaged, but the key cannot be extracted since it is captured, in the customary way, by the pins 36 disposed between the wall of the bore 32 and the notches in the key 44.

Figure 10:
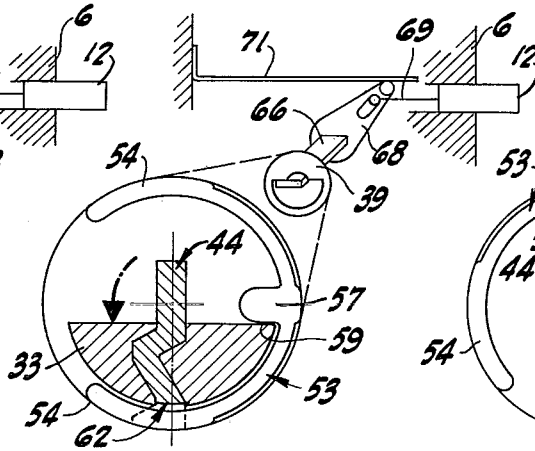
FIG. 10 is a view like FIG. 9 with the key and plug turned another quarter turn from the FIG. 9 position in a counterclockwise direction and with the bolt still projected.

In the next 90° turn from the FIG. 9 position to the FIG. 10 position, the plug 33 and the disc 39 both return to their original positions, taking up the remainder of the lost motion. More importantly, the key notch 62 engages the other end shoe 54 of the displaced ring. Although the key is in its initial position and the pins 36 are lined up in positions to permit key extraction, nevertheless the ring end in the notch 62 retains the key against withdrawal as the bolt 12 is still projected.

Figure 11:
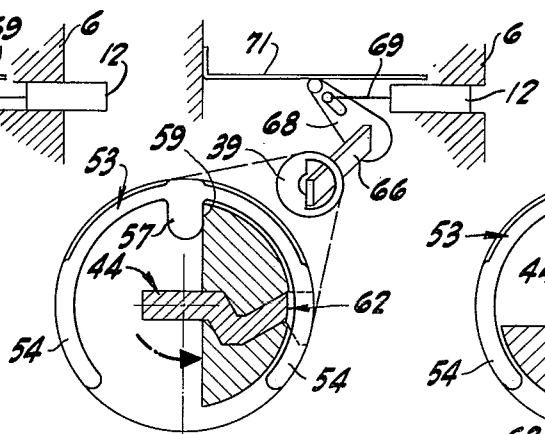
FIG. 11 is a view like FIG. 10 but with the key and plug turned a quarter turn in a counterclockwise direction from the FIG. 10 position and with the bolt retracted.

In going further counterclockwise through the next 90° from the FIG. 10 position to the FIG. 11 position, the key turns the plug 33 and the disc 39 simultaneously and the disc chordal surface 42 in engagement with the driver bar 66 rotates the crank 68 and, through the link 69, withdraws the bolt 12 to retracted position, the spring 71 again flexing and relaxing to afford a snap return action.

Figure 12:
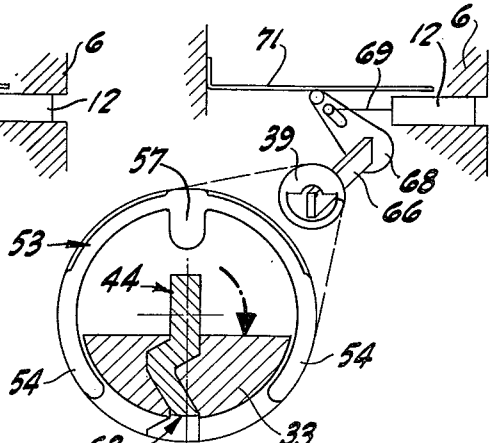
FIG. 12 is a view like FIG. 11 but with the key and plug turned clockwise a quarter turn from the FIG. 11 position in a key inserting and retracting position and with the bolt retracted.

Finally, with the bolt 12 returned or retracted and the ring 53 in original position, the key is manually turned clockwise 90° from the FIG. 11 position to the FIG. 12 position. Since the ring 53 is braked or frictionally held, it remains in place as the plug and key move back to starting position and the notch leaves the ring end; i.e., the ring moves relative to the notch from the second position to the first position. The bolt is retracted and the key is no longer blocked or restrained and can readily be withdrawn in the usual way. Since the construction is symmetrical, both left-hand and right-hand devices can be accommodated.

Figure 13:
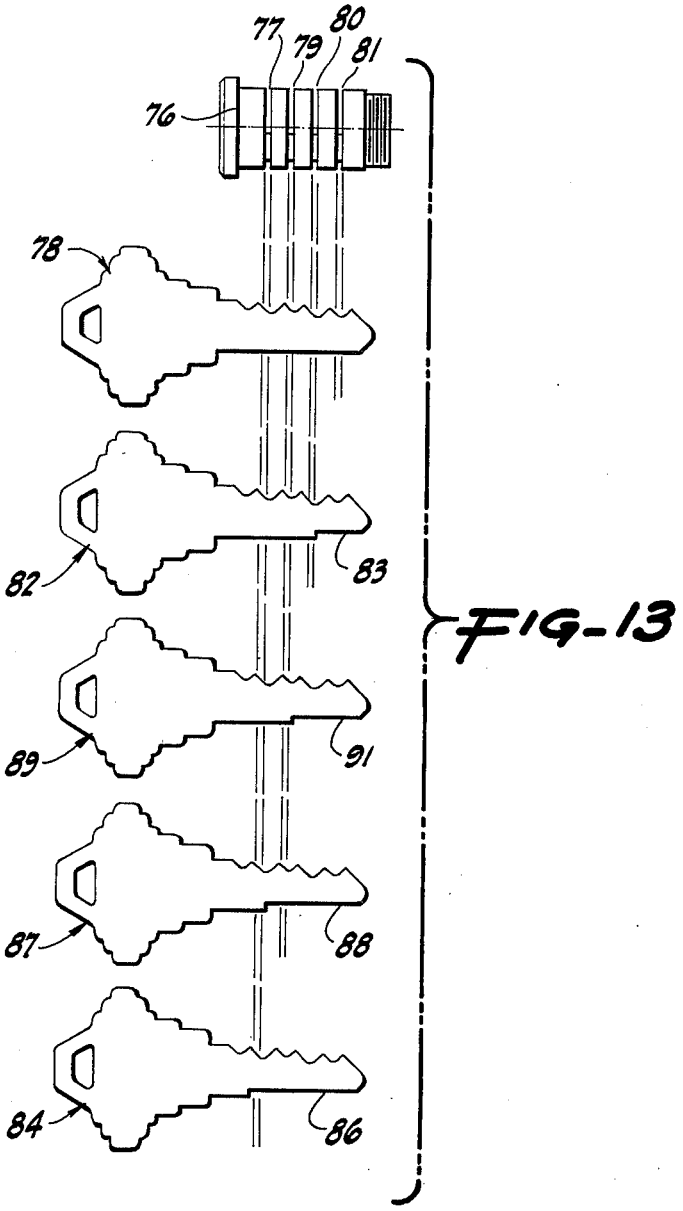
FIG. 13 is a diagram showing the interrelationship of a lock plug with a family of keys usable therewith.

The arrangement also adapts itself to use with keys of different forms, as shown in FIG. 13. The plug 76 is just like the plug 33 and has a similar groove 77 therein. If a standard key 78, without a notch 62, is used, the normal operation is followed, but without any retention of the key 78. There is enough lost motion between the plug and a partial ring 53 in the groove 77 so that the key and plug operate in the usual way. The plug may also have one or more additional grooves 79, 80 and 81, for example. The partial ring 53 can occupy any of those grooves rather than the groove 77, or similar partial rings can be installed in any one or more of the grooves.

If, for example, a partial ring is put in the groove 81, and a key 82 with a short open notch 83 is then used, the plug is operated and the partial ring is moved to intersect the keyway, as before, but the key 82, because of the short notch 83, is not blocked by the partial ring and can be withdrawn. Thereafter, the key 78 cannot be fully entered into the keyway, but is shut out by the rotated partial ring in the groove 81. This same shut-out feature is attainable with partial rings in the other grooves 77, 79 and 80 by using a key such as 84 with a long open notch 86, a key 87 with a long intermediate open notch 88, or a key 89 with a short intermediate open notch 91. A partial ring in any position shuts out all keys longer than that position or having an open notch shorter than that position and can be set by a key having an open notch longer than that position.

While in the foregoing the mechanism is arranged to retain the key when the bolt is in its projected position, there may be instances in which it is desired to retain the key when the bolt is in its retracted position. This is easily arranged by interconnecting the driver bar 66 and the crank 68 at 90° to the position shown in FIG. 6, for example. If this is a slot connection, two slots at 90° to each other will permit the selection of either mode of operation at assembly.

What is claimed is:

1. A key retaining cylinder lock device comprising a cylinder body having a bore therein extending along an axis, a plug rotatable in said bore about said axis, means in said plug forming a keyway extending in an axial direction and adapted to receive therein a key provided with an edge notch partly defined by an inner wall oriented at least partially transversely of said axis, and blocking means within said body bore and on said plug movable between a first position out of said keyway and a second position in said keyway in the withdrawal path of said inner wall during withdrawal of said key from said keyway.

2. A device as in claim 1 in which said plug has a concentric circumferential groove open to said keyway, and said blocking means is a partial ring in said groove.

3. A device as in claim 2 in which said blocking means is axially spaced from the ends of said key in said keyway.

4. A device as in claim 2 in which said plug has a chamber open to said groove and open to said keyway and partially defined by a plug chordal surface disposed transversely on both sides of said keyway.

5. A device as in claim 4 in which said keyway has a central axial plane, and said plug chordal surface is disposed perpendicular to said plane.

6. A device as in claim 5 in which said partial ring is flat and has a plane of symmetry and includes a flat lug symmetrical with said plane and extending inwardly of said ring.

7. A device as in claim 6 in which said partial ring also includes external end shoes adapted frictionally to engage the wall of said bore.

8. A device as in claim 2 in which said blocking means has inner and outer side walls adjacent the walls of said groove and has ends engaging said body on the inside of said bore.

9. A device as in claim 1 in which said blocking means is a partial ring having free ends engaging said cylindrical body and is substantially rectangular in axial cross-section and in said second position substantially fills said edge notch.

10. A device as in claim 1 including an axially extending flat driver bar, a connector between said plug and said driver bar affording rotary lost motion therebetween, said connector being a disc substantially perpendicular to said axis, means forming an opening in said disc for said driver bar and in part defined by a disc chrodal surface, and means on said plug defining a plug chordal surface parallel to said disc chordal surface.

11. A device as in claim 6 in which said chordal surface and said lug are disposed to provide rotary lost motion therebetween.

12. A device as in claim 11 in which said rotary lost motion is substantially 180°.

13. A key retaining cylinder lock device comprising a cylinder body having a bore therein extending along an axis, a plug rotatable in said bore about said axis, means in said plug forming a keyway extending in an axial direction and adapted axially to receive therein a key provided with an edge irregularity, a bolt movable between an extended position and a retracted position, means for connecting said plug to move said bolt between said positions when said plug is rotated in said bore by said key, and means entirely within said cylinder body and effective when said bolt is in said extended position and ineffective when said bolt is in said retracted position for retaining said key in said keyway against axial movement therein.

* * * * *